US008087185B2

(12) United States Patent
LeClerc

(10) Patent No.: US 8,087,185 B2
(45) Date of Patent: Jan. 3, 2012

(54) CLOTHES DRYER DOOR HINGE

(75) Inventor: Martin LeClerc, Lachenaie (CA)

(73) Assignee: Mabe Canada Inc, Burlington (CA)

( * ) Notice: Subject to any disclaimer, the term of this patent is extended or adjusted under 35 U.S.C. 154(b) by 812 days.

(21) Appl. No.: 12/222,628

(22) Filed: Aug. 13, 2008

(65) Prior Publication Data

US 2009/0064534 A1 Mar. 12, 2009

(30) Foreign Application Priority Data

Sep. 11, 2007 (CA) ..... 2610078

(51) Int. Cl.
*F26B 11/02* (2006.01)

(52) U.S. Cl. ..... 34/603; 34/595; 34/139

(58) Field of Classification Search ..... 34/595, 34/603, 139

See application file for complete search history.

(56) References Cited

U.S. PATENT DOCUMENTS 4,934,559 A 6/1990 Putnam
7,581,414 B2 * 9/2009 Kim et al. ..... 68/196
2004/0083769 A1 5/2004 Kim et al.
2004/0089031 A1 5/2004 Kim et al.
2005/0017612 A1 1/2005 Park
2006/0059710 A1 3/2006 Kim
2006/0101873 A1 5/2006 Kim et al.
2010/0295428 A1 * 11/2010 Favaro et al. ..... 312/228

FOREIGN PATENT DOCUMENTS

CA 2091941 3/1993

* cited by examiner

*Primary Examiner* — Jiping Lu

(57) ABSTRACT

A clothes dryer has a reclined front panel and a door mounted thereto by a hinge assembly. The assembly has a support plate and a pivoting member. The support plate is mounted to the rear of the front panel and has upper and lower hinge locating seat portions respectively recessed from the reclined front panel by first and second predetermined distances. The pivoting member has first and second end portions pivotally connected together along a vertical axis. The first end portion is mounted to the door. The second end portion is mounted with the front panel via the support plate. The second end portion has upper and lower horizontally extending arms respectively connected to the upper and lower hinge locating seat portions. The arms have lengths chosen relative to the first and second predetermined distances so as to vertically locate the vertical axis adjacent the reclined front panel.

20 Claims, 8 Drawing Sheets

CLOTHES DRYER DOOR HINGE

FIELD OF THE INVENTION

The present invention relates to a clothes dryer door hinge for use with a reclined front panel of a clothes dryer where a hinge pivoting member pivots a door relative to the front panel about an axis that is vertical with respect to ground.

BACKGROUND TO THE PRESENT INVENTION

A clothes dryer typically comprises a cabinet having a front panel, a rear panel, a pair of side panels spaced apart from each other by the front and rear panels, and a top cover. Within the cabinet is a drum mounted for rotation around a substantially horizontal axis. A motor rotates the drum about the horizontal axis through, for example, a pulley and a belt. The drum is generally cylindrical in shape, has an outer cylindrical wall, and has an open front end. The front panel has a central access opening adjacent the open front end of the drum to permit clothing articles and other fabrics to be loaded into the drum through the access opening. The access opening in the front panel is closed by a door that is attached through a hinge assembly to the front panel of the clothes dryer.

In the past, the clothes dryer typically comprises a vertically extending front panel and includes a hinge assembly for mounting the door to the front panel where the hinge assembly pivots about a vertical axis. In another known laundry appliance the axis of the hinge member is angled relative to the vertical to reduce the load associated with opening and closing the door.

BRIEF DESCRIPTION OF THE INVENTION

The present invention relates to a clothes dryer door hinge for use with a reclined front panel of a clothes dryer where a hinge pivoting member pivots a door relative to the front panel about an axis that is vertical with respect to ground. By reclining the front panel at an small angle, the appearance of the clothes dryer is altered to provide a sleeker appearance that is appealing to users. Moreover, by maintaining the axis of hinge pivoting member vertical, the door attached to the hinge member tends to open and close without the door canting and jamming with respect to the front panel of the clothes dryer during opening or closing while at the same time preserving the appearance of the front of the clothes dryer.

In one embodiment there is provided a clothes dryer comprising a reclined front panel, a door and a hinge assembly for pivotally connecting the door with the reclined front panel to allow pivotal movement of the door about a first vertical axis. The reclined front panel is reclined from a vertical plane by a first predetermined angle. The reclined front panel has an access opening passing therethrough permitting clothing articles to be placed into and removed from the dryer. The reclined front panel has spaced apart upper and lower apertures passing therethrough and located one above the other adjacent one side of the access opening. The door is provided to open and close the access opening. The hinge assembly comprises a support plate and a pivoting member. The support plate is mounted to a rear surface of the reclined front panel and comprises an upper hinge locating seat portion positioned adjacent the upper aperture and recessed from the reclined front panel by a first predetermined distance, and a lower hinge locating seat portion positioned adjacent the lower aperture and recessed from the inclined front panel by a second predetermined distance The pivoting member has pivotally connected first and second end portions which pivot about the first vertical axis The first end portion is mounted to the door and the second end portion is mounted with the reclined front panel via the support plate. The second end portion comprises upper and lower horizontally extending arms that pass through the upper and lower apertures in the reclined front panel The upper and lower horizontally extending arms are attached to the support plate respectively at the recessed upper and lower hinge locating seat portions. The upper and lower arms have respective predetermined lengths between the first vertical axis and the respective recessed upper and lower hinge locating seat portions chosen relative to the first and second predetermined distances so as to vertically locate the first vertical axis.

While the front panel is described as having upper and lower apertures located one above the other, in the preferred embodiment, the upper and lower apertures have a portion of the front panel placed therebetween to improve the visual appearance of the front panel at the hinge. In this embodiment the hinge support plate is, for the most part, hidden from view. In an alternative embodiment, the upper and lower apertures may comprise upper and lower aperture extensions of a slotted aperture whereby there is no front panel portion located between the upper and lower apertures.

In one embodiment, the first predetermined distance is chosen to be larger than the second predetermined distance and the first predetermined length is chosen to be greater than the second predetermined length to vertically align the first vertical axis. In another embodiment, the first predetermined distance is chosen to be smaller than the second predetermined distance and the first predetermined length is chosen to be less than the second predetermined length to vertically align the first vertical axis. In a preferred embodiment, the first predetermined distance is chosen to be smaller than the second predetermined distance and the first predetermined length is chosen to be equal to the second predetermined length to vertically align the first vertical axis. It should be understood that the vertical axis is vertical relative to ground.

The front panel is reclined by a small angle from the vertical plane. It is envisaged that this angle may be in the range of 1 to 3 degrees to provide the sleek visual effect for the dryer. In the preferred embodiment, the first predetermined angle is 1.38 degrees.

It is envisaged that the support plate comprises upper and lower recessed wall portions that respectively include the upper and lower hinge locating seat portions. In one embodiment, the upper and lower recessed wall portions respectively abut the upper and lower horizontally extending arms and the assembly further comprises mounting screws that pass through the upper and lower horizontally extending arms and through the upper and lower walls at the recessed upper and lower hinge locating seat portions to mount the second end portion of the pivoting member to the support plate of the hinge assembly. The upper and lower recessed walls may respectively slope over the upper and lower apertures at a second predetermined angle whereby the screws are inserted into the upper and lower arms through the upper and lower apertures of the front panel facilitating of the door to the front panel. Preferably, the second predetermined angle is 60 degrees. The insertion of the screws through the upper and lower apertures on the front panel allow for front access mounting of the pivoting member with the front panel after the front panel has been assembled to the dryer cabinet.

Preferably, the support plate of the hinge assembly is mounted directly to the rear surface of the support wall. In an alternative embodiment, the hinge assembly may further comprise an angled wedge member interspaced between the rear surface of the front panel and the support plate. The angled wedge member has a wedge predetermined angle equal to the first predetermined angle whereby the support plate is mounted vertically relative to the rear surface of the front panel.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE DRAWINGS

The present invention relates to a clothes dryer door hinge for use with a reclined front panel of a clothes dryer where a hinge pivoting member pivots a door relative to the front panel about an axis that is vertical with respect to ground.

Figure 1:
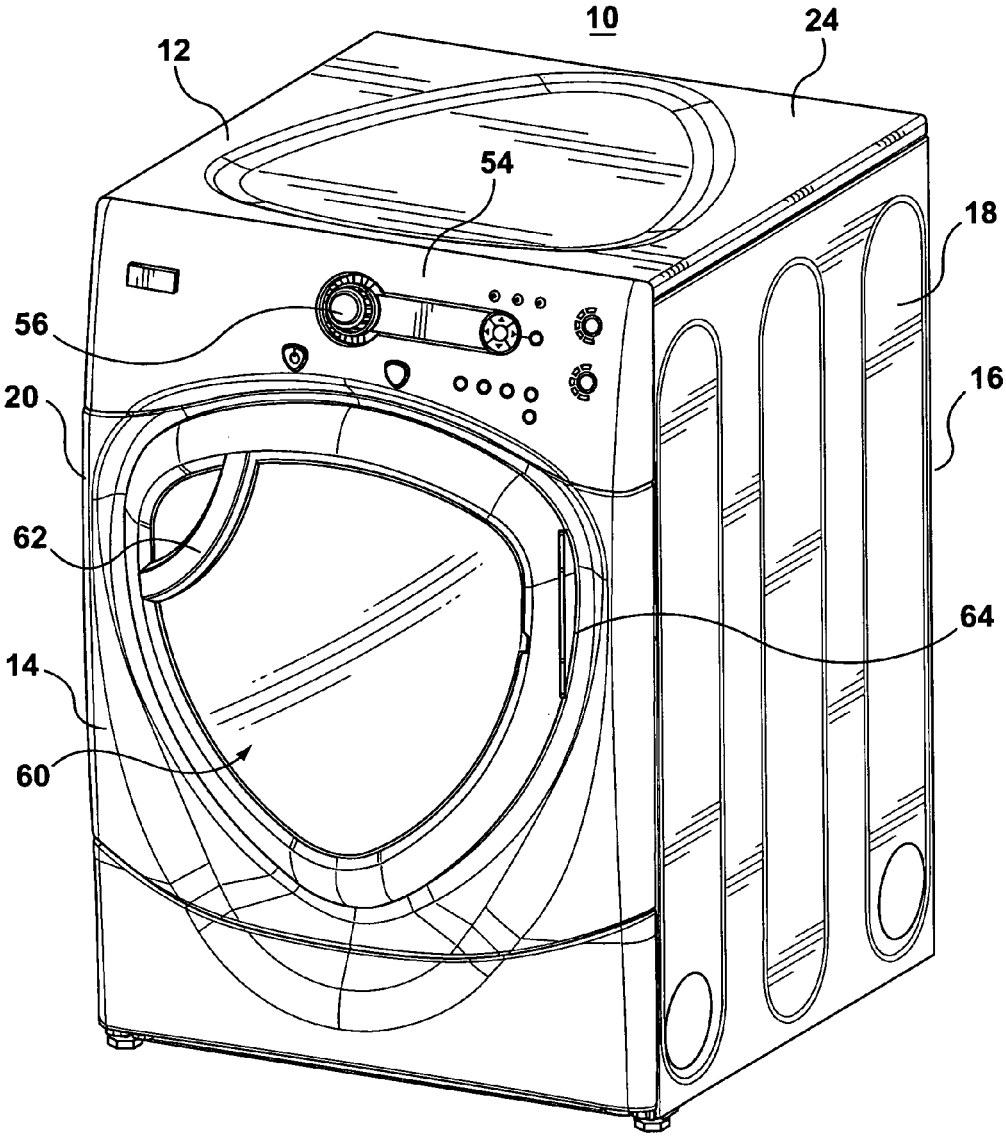
FIG. 1 is a perspective view of an exemplary clothes dryer that may benefit from the present invention.
Figure 2:
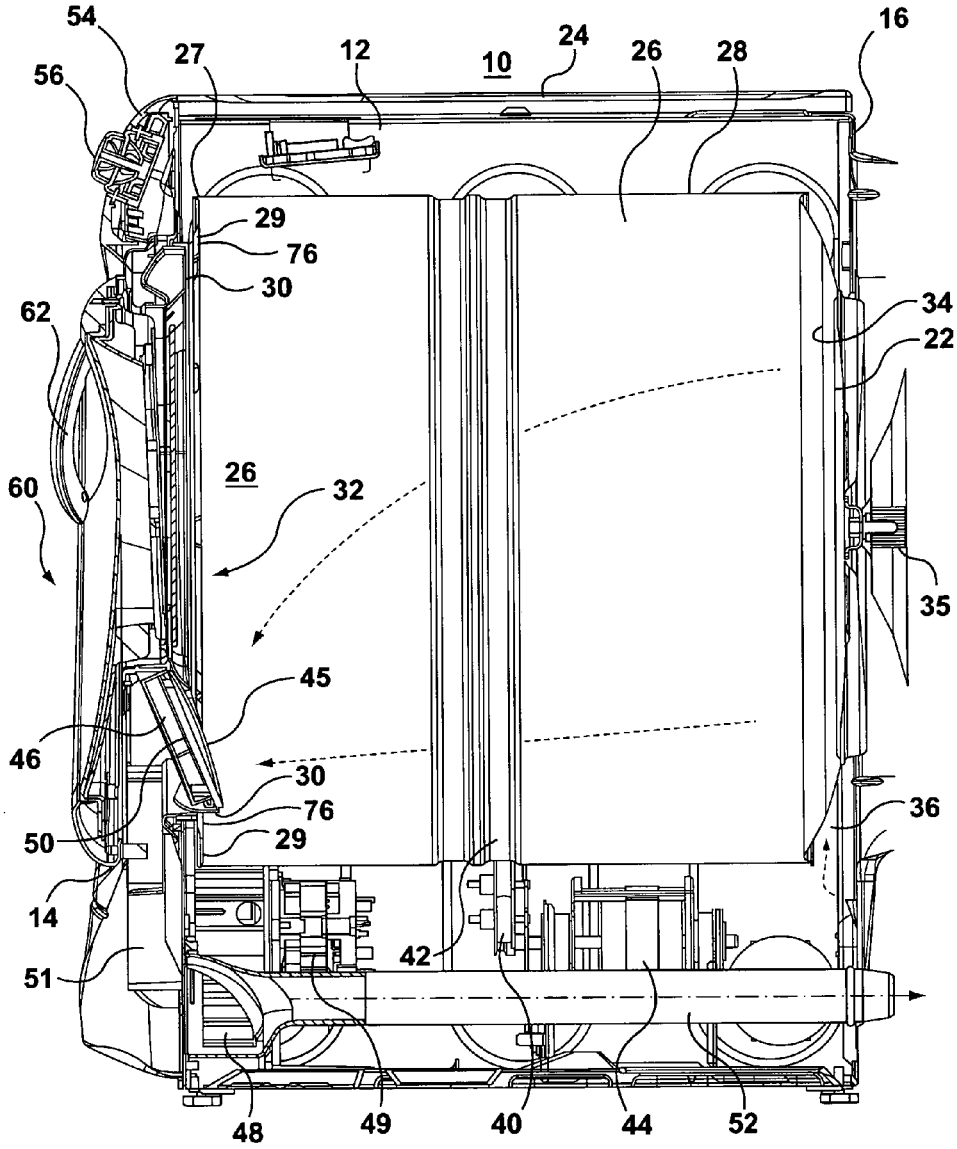
FIG. 2 is a side sectional view of an exemplary clothes dryer that may benefit from the present invention.

FIGS. 1 and 2 show perspective and side sectional views of an exemplary clothes dryer 10 that may benefit from the present invention. The clothes dryer 10 includes a cabinet or a main housing 12 having a front panel 14, a rear panel 16, a pair of side panels 18 and 20 spaced apart from each other by the front and rear panels, and a top cover 24. Within the housing 12 is a drum 26 mounted for rotation around a substantially horizontal axis. A motor 44 rotates the drum 26 about the horizontal axis through, for example, a pulley 40 and a belt 42. The drum 26 is generally cylindrical in shape, has an outer cylindrical wall 28, and has an open end 27 that typically comprises a metal ring 29 attached by welding to the drum 26 for reducing the diameter of the opening of the drum 26 to match a front bulkhead structure or bearing 30. The front panel 14 and the bearing 30 define an access opening 32 into the drum 26. Clothing articles and other fabrics are loaded into and removed from the drum 26 through the access opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by a suitable fixed bearing 35. The rear wall 34 includes a plurality of holes (not shown) that receive hot air that has been heated by a heater such as electrical heating elements (not shown) in the heater housing 22. The housing 22 receives ambient air via an inlet 36. Although the exemplary clothes dryer 10 shown in FIG. 1 is an electric dryer, it could just as well be a gas dryer having a gas burner.

After the clothing articles have been dried, they are removed from the drum 26 via the access opening 32. The dryer has a control panel 54 with touch and or dial controls 56 whereby a user can control the operation of the dryer.

Clothes are inserted into, and removed from, the drum 26 through access opening 32. Access opening 32 is shown closed by a window or port-hole like door 60. Door 60 has a handle 62 for pivotally opening the door about a hinge hidden from view in FIG. 1 by door mounted decorative plastic cap 64.

Heated air is drawn from the drum 26 by a blower fan 48 which is also driven by a second motor 49 in the embodiment shown. In an alternative embodiment, motor 44 could be used to drive blower fan 48. The air passes out of the drum through a grill 45 and screen filter 46. Grill 45 keeps clothing articles tumbling in the drum 26 from contacting the filter 46 and touching the lint trapped by the filter 46 within the trap duct 50. As the air passes through the screen filter 46, it flows through lower duct portion 51 and is drawn by blower wheel 48 attached to motor 49 out of the clothes dryer through an exhaust duct 52. In this embodiment, the drum 26 is in air flow communication with the trap duct 50 whose lower duct portion 51 has an outlet that is in air flow communication with the blower wheel 48 and the exhaust duct 52.

Referring FIGS. 3 through 6, a preferred embodiment of a hinge assembly 70 for the present invention is shown. The hinge assembly 70 is adapted to pivotally connect to door 60 with the front panel 14 to allow pivotal movement of the door 60 about a first vertical axis 72.

Figure 3:
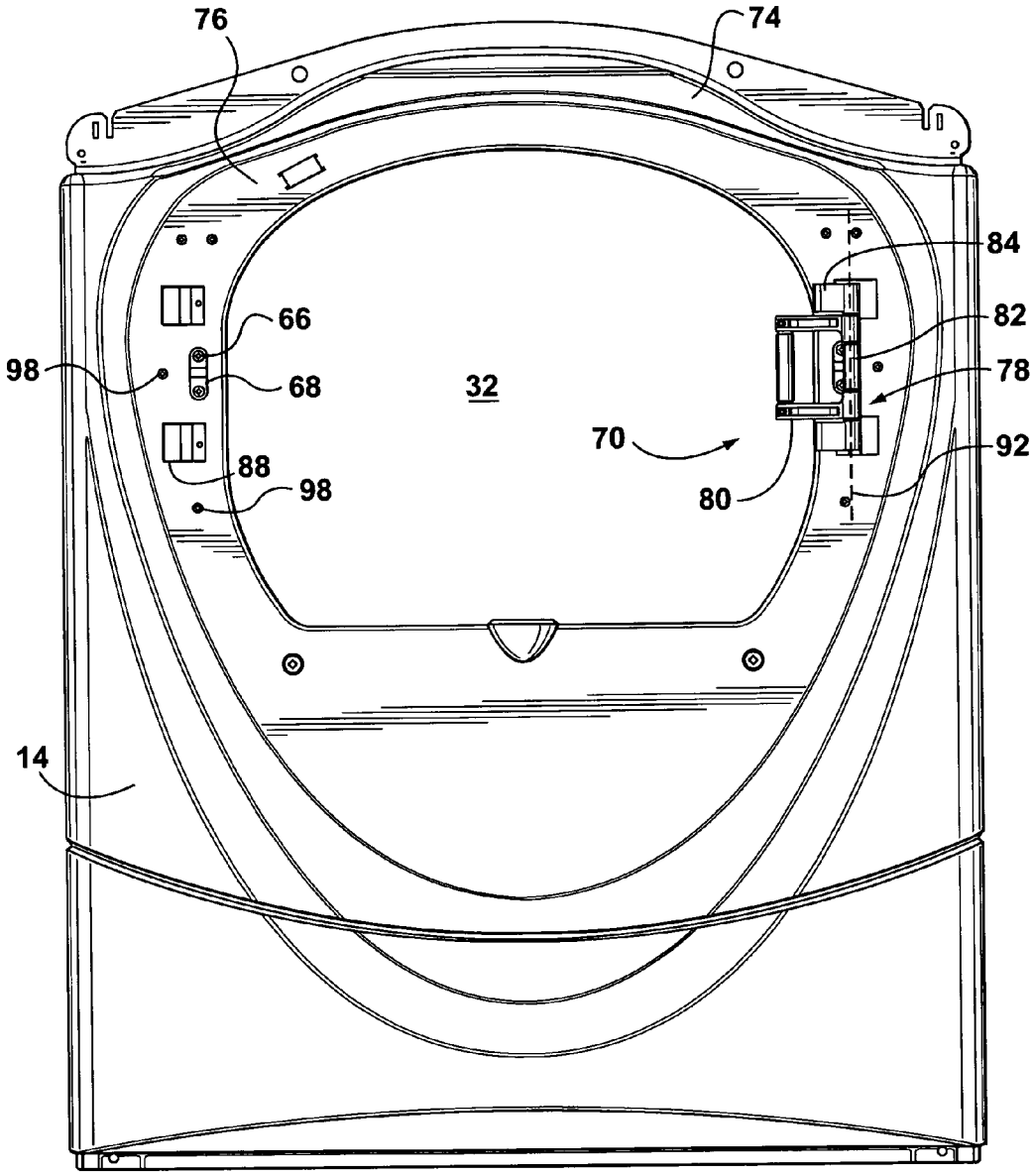
FIG. 3 is a front view of the front panel with the door removed.

In FIG. 3, the front panel 14 is shown to comprise a main supporting portion 74 and a recessed skirt portion 76 into which door 60 is fitted. The recessed skirt portion 76 surrounds the access opening 32. The right side of FIG. 1 shows the hinge assembly 70 connected to the front panel 14 without the door 60 attached thereto. The portion of the hinge assembly shown in FIG. 1 comprises the pivoting member 78. Pivoting member 78 has a first end portion 80 pivotally connected via hinge pin 82 to a second end portion 84. First end portion 80 is adapted for insertion into and connection with the door 60 (not shown in FIG. 3). Behind this hinge assembly 70 are a pair of spaced apart upper and lower apertures 86 and 88 (see FIG. 5). Corresponding or similar apertures are also shown on the left hand side of the front panel 14 at the same numbers 86 and 88. The apertures 86 and 88 on the left side of the panel 14 are provided to allow the door 60 to be reversibly mounted to the front panel if necessary. When not in use apertures 86, 88 are covered by plastic caps. As shown in FIG. 3 between the left side apertures 86, 88 is a latch 68 held in place by screws 66. Latch 68 receives a hook like tab member (not shown) located at door 60 to latch the door in a closed position covering access opening 32.

Figure 5:
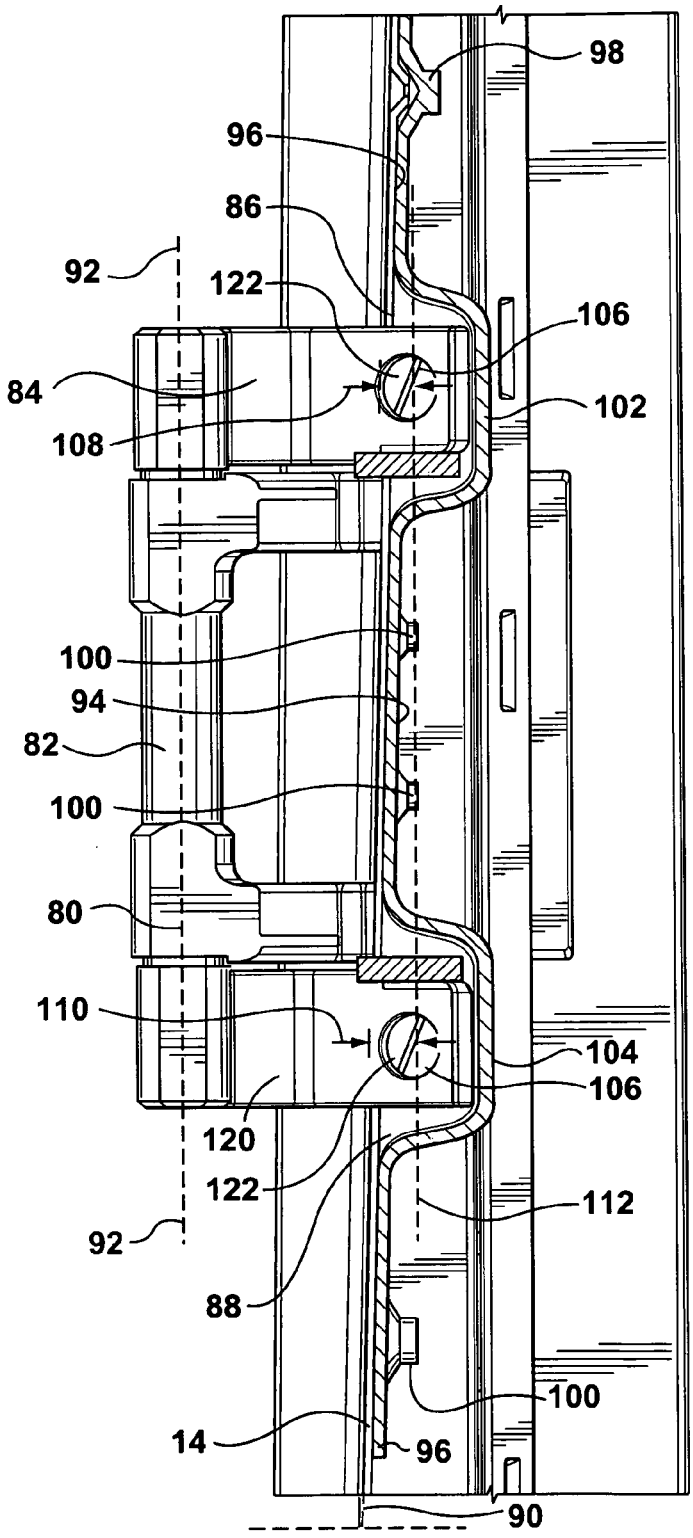
FIG. 5 is an enlarged section view taken along line V-V of FIG. 4.

As shown in FIG. 5 the front panel 14 is reclined by a predetermined angle 90. This angle 90 is a relatively small angle and in the preferred embodiment is 1.38 degrees reclined from the vertical. The purpose of reclining the front panel 14 is to provide a sleeker more visual appearance. In the preferred embodiment, the front panel 14 between its lower portion and its upper portion may recline by as much as a ½ inch over a height of 20 inches. In order to ensure that the door 60 can be hung with respect to ground properly, the axis 92 of the hinge pin 82 extends vertically with respect to ground. The vertical alignment of hinge pin 82 is provided by the hinge assembly 70 as is described in more detail hereinafter.

As best seen in FIGS. 3 to 6, the hinge assembly 70 comprises a support plate 94 that is directly mounted to rear surface 96 of the front panel 14. Hinge plate mounting apertures 98 are located in the front panel 16 so that screws 100 pass through these apertures 98 and into and through the support plate 94 to directly mount the support plate 94 to the rear surface 96 of the front panel 14. The support plate 94 comprises upper and lower recess sockets 102 and 104. The upper and lower sockets 102 and 104 each comprise respectively upper and lower hinge locating seat portions 106. The upper hinge locating seat portion 106 is positioned adjacent the upper aperture 86 and recessed from the front panel 14 by a first predetermined distance 108. The lower hinge locating seat portion 106 is positioned adjacent the lower aperture 88 and recessed from the inclined front panel by a second predetermined distance 110. The second predetermined distance is greater than the first predetermined distance whereby the upper and lower hinge locating seat portions 106 are aligned and define a second vertical axis 112 extending therebetween.

The upper and lower hinge locating seat portions 106 are each supported respectively in upper and lower recessed wall portions 114. The upper and lower recessed wall portions 114 extend rearwardly of the front panel 14 at an angle so that they slope over the respective upper and lower apertures 86, 88 at a second predetermined angle 116 which in this preferred embodiment is 60 degrees.

Figure 4:
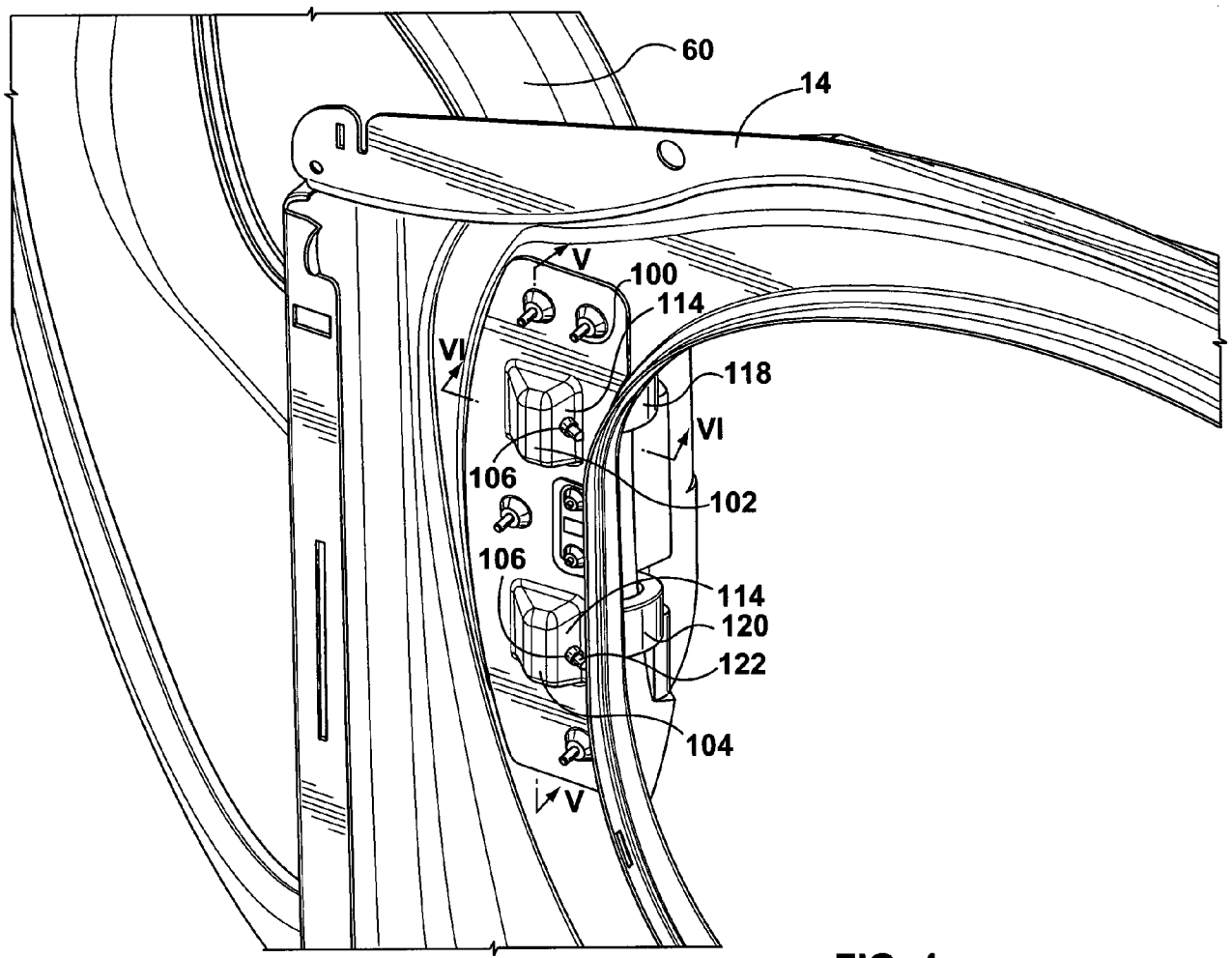
FIG. 4 is a rear perspective view of a portion of the front panel, hinge assembly and a portion of the door.
Figure 6:
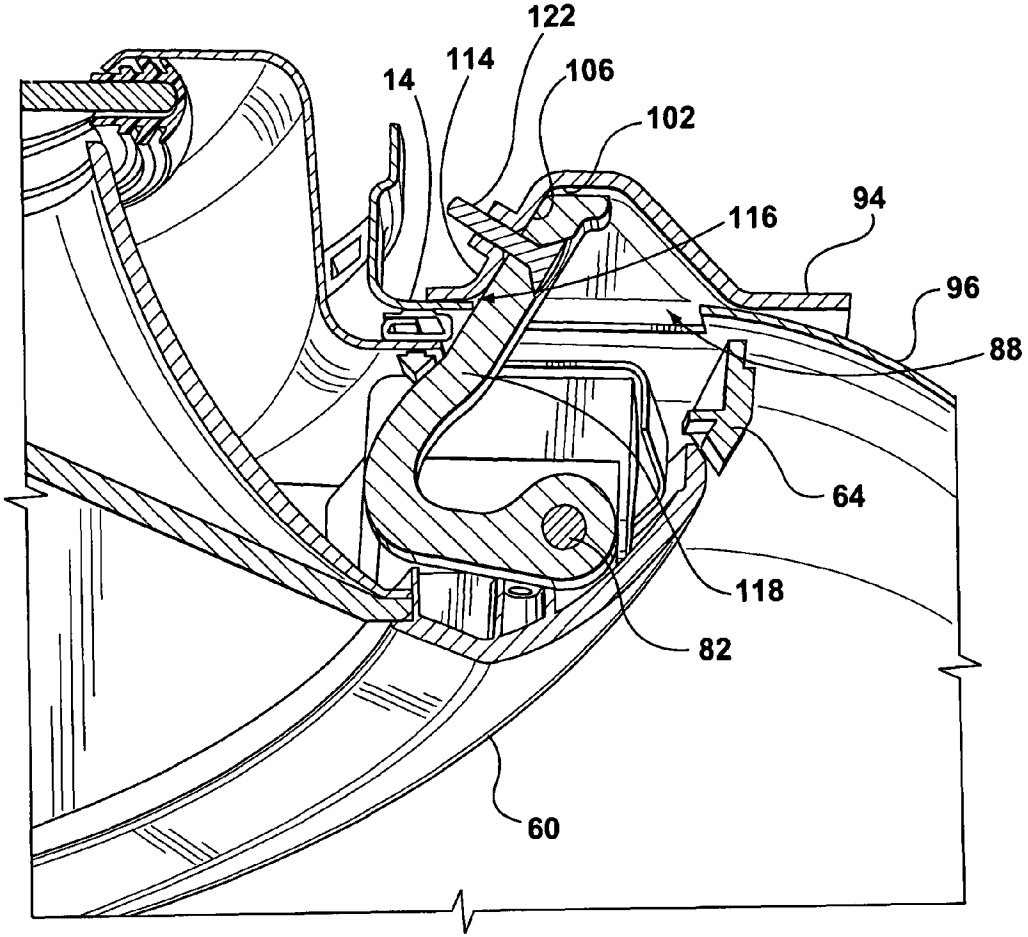
FIG. 6 is a sectional view taken along line VI-VI of FIG. 4.

It should be understood that the first end portion 80 of the hinge assembly 70 is viewable in FIGS. 3 and 5 because in these Figures the door 60 has been removed for illustrative purposes only. In FIG. 4, the door 60 is shown attached to the first end portion 80 of the hinge 70 and as such the first end portion is not viewable. Further the hinge pin 82 is also normally positioned inside door 60. The second end portion 84 comprises upper and lower horizontally extending arms 118, 100 that pass respectively through the upper and lower apertures 86, 88 of the front panel 14. The upper and lower horizontally extending arms 118, 120 are attached to the support plate 94 respectively at the recessed upper and lower hinge locating seat portions 106 by means of locating screws 122. In the embodiment shown the upper and lower arms 118, 120 have lengths that are equal in view of the fact that the upper and lower seating portions 106 in the plate 94 have been aligned vertically. As best shown in FIG. 6, the arm 118 abuts against the wall 114 when arm 118 is mounted in place. To mount door 60 to panel 14, cap 64 is removed from the door 60, and access through apertures 86, 88 in the front panel 14 can be made by a screwdriver to directly access the locating screws 122. This facilitates the removal and the assembly of the hinge pivoting member 78 to the hinge support plate 94.

As shown in FIG. 6, the arm 116 of the pivoting member 78 extends through the aperture 88 into the recess socket 102 of the hinge support plate 94 for connection with the hinge support plate 94 to thereby mount the door 60 relative to the front panel 14 via the hinge support plate 94. Thereafter cap 64 is placed onto the door and most of the hinge elements remain hidden from view, particularly when the door is closed.

Figure 7:
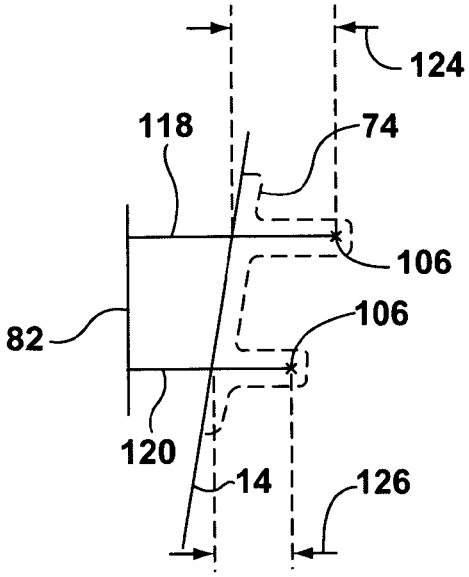
FIGS. 7 and 8 are schematic drawings illustrative of alternative embodiments; and, FIG. 9 is a schematic representation of an alternative embodiment for the hinge assembly utilizing an angled wedge member between the support plate and rear surface of the front panel.
Figure 8:
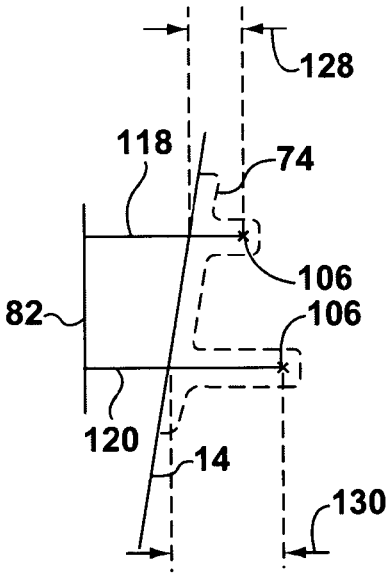

Referring to FIGS. 7 and 8, schematic representations of alternative embodiments are shown wherein the upper and lower hinge locating seat portions 106 are located different predetermined distances in from the front panel 14. In FIG. 7, the first predetermined distance 124 is greater than the second predetermined distance 126. To vertically orientate the axis 82, the upper and lower horizontally extending arms 118, 120 are chosen such that the length of the upper arm 118 is greater than the length of the lower arm 120.

In FIG. 8, the first predetermined distance 128 is less than the second predetermined distance 130 and consequently the length of the upper arm 118 is chosen to be less than the lower arm 120 whereby the hinge axis 82 extends vertically.

Figure 9:
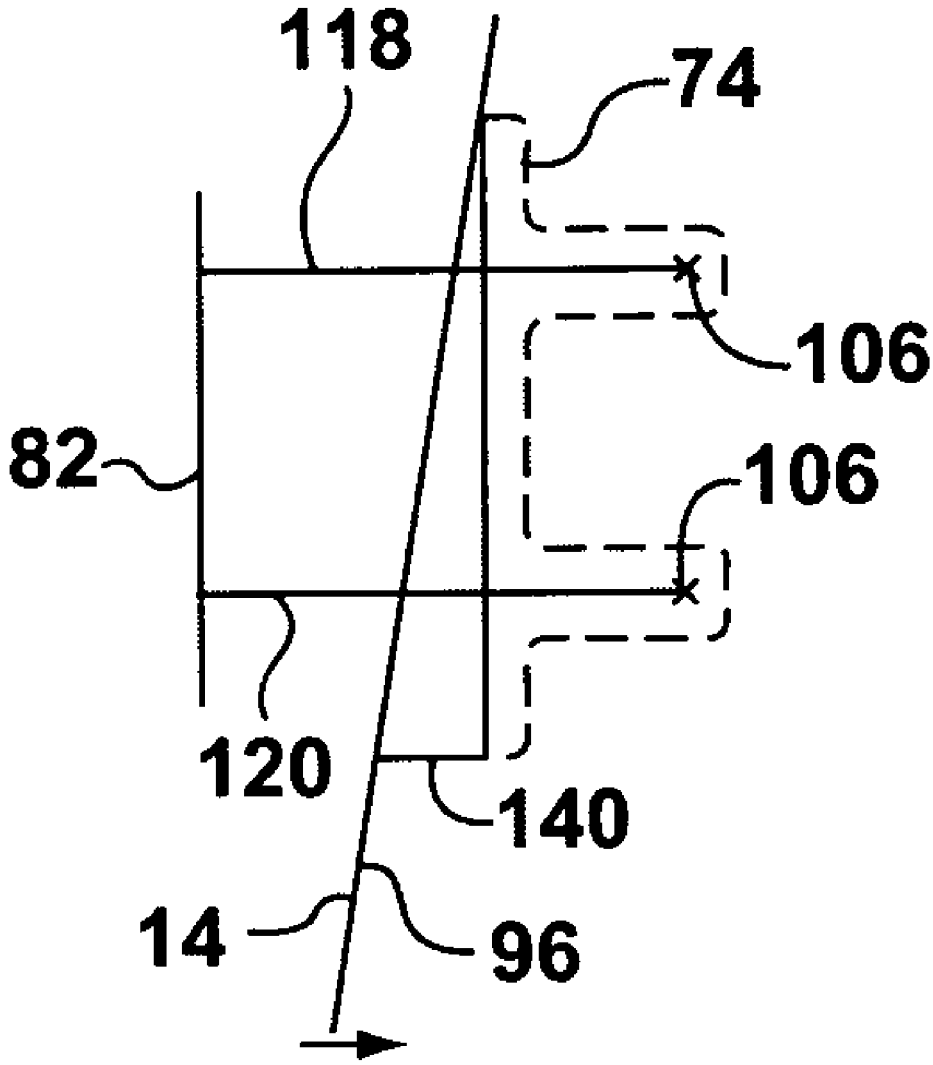

Referring to FIG. 9 there is a further schematic representation of an alternative embodiment showing a wedge-shaped member 140 located attached to the rear surface 96 of the front panel 14. The wedge 140 is angled such that is matches the reclined angle of the front panel 14 to orientate the hinge support plate 94 vertically. In this embodiment, the hinge support plate 94 is not connected or mounted directly to the front panel 14 but is mounted indirectly thereto via the wedge-shaped member 140.

While the invention has been described in terms of various specific embodiments, those skilled in the art will recognize that the invention can be practiced with modifications within the spirit and scope of the present invention as disclosed herein.

What is claimed is:

1. A clothes dryer comprising:

a reclined front panel reclined from a vertical plane by a first predetermined angle, the reclined front panel having an access opening passing therethrough permitting clothing articles to be placed into and removed from the dryer, and the reclined front panel having spaced apart upper and lower apertures passing therethrough and located one above the other adjacent one side of the access opening;

a door for opening and closing the access opening;

a hinge assembly for pivotally connecting the door with the reclined front panel to allow pivotal movement of the door about a first vertical axis; the hinge assembly comprising:

a support plate mounted to a rear surface of the reclined front panel, the support plate comprising an upper hinge locating seat portion positioned adjacent the upper aperture and recessed from the reclined front panel by a first predetermined distance, and a lower hinge locating seat portion positioned adjacent the lower aperture and recessed from the inclined front panel by a second predetermined distance greater than the first predetermined distance whereby the upper and lower hinge locating seat portions are aligned and define a second vertical axis extending therebetween; and, a pivoting member having pivotally connected first and second end portions which pivot about the first vertical axis, the first end portion being mounted to the door and the second end portion being mounted with the reclined front panel via the support plate, the second end portion comprising upper and lower horizontally extending arms that pass through the upper and lower apertures in the reclined front panel, the upper and lower horizontally extending arms being attached to the support plate respectively at the recessed upper and lower hinge locating seat portions, and the upper and lower arms having equal lengths between the first vertical axis and the respective recessed upper and lower hinge locating seat portions.

2. The clothes dryer of claim 1 wherein the pivoting member comprises an elongated hinge pin extending along the first vertical axis interconnecting the first and second end portions.

3. The clothes dryer of claim 1 wherein the support plate comprises upper and lower recessed wall portions that respectively include the upper and lower hinge locating seat portions.

4. The clothes dryer of claim 3 wherein the upper and lower recessed wall portions respectively abut the upper and lower horizontally extending arms and the assembly further comprising mounting screws that pass through the upper and lower horizontally extending arms and through the upper and lower recessed wall portions at the recessed upper and lower hinge locating seat portions to mount the second end portion of the pivoting member to the support plate of the hinge assembly.

5. The clothes dryer of claim 4 wherein the upper and lower recessed wall portions respectively slope over the upper and lower apertures at a second predetermined angle whereby the screws are inserted into the upper and lower arms through the upper and lower apertures.

6. The clothes dryer of claim 5 wherein the second predetermined angle is 60 degrees.

7. The clothes dryer of claim 6 wherein the support plate comprises upper and lower recessed sockets respectively extending over the upper and lower apertures, the upper and lower recessed sockets comprising the upper and lower recessed wall portions that respectively include the upper and lower hinge locating seat portions.

8. The clothes dryer of claim 1 wherein the first predetermined angle is in the range of 1 to 3 degrees.

9. The clothes dryer of claim 1 wherein the first predetermined angle is 1.38 degrees.

10. The clothes dryer of claim 1 wherein the reclined front panel comprises a main portion and a recessed skirt portion that the surrounds the access opening and is recessed from the main portion, and wherein the spaced apart upper and lower apertures are located in the skirt portion adjacent the one side portion of the access opening.

11. The clothes dryer of claim 1 wherein the support plate is mounted directly to the rear surface of the support wall.

12. The clothes dryer of claim 1 wherein the hinge assembly further comprises an angled wedge member interspaced between the rear surface of the front panel and the support plate, the angled wedge member having a wedge predetermined angle equal to the first predetermined angle whereby the support plate is mounted vertically relative to the rear surface of the front panel.

13. A clothes dryer comprising:

a reclined front panel reclined from a vertical plane by a first predetermined angle, the reclined front panel having an access opening passing therethrough permitting clothing articles to be placed into and removed from the dryer, and the reclined front panel having spaced apart upper and lower apertures passing therethrough and located one above the other adjacent one side of the access opening;

a door for opening and closing the access opening;

a hinge assembly for pivotally connecting the door with the reclined front panel to allow pivotal movement of the door about a first vertical axis; the hinge assembly comprising:

a support plate mounted to a rear surface of the reclined front panel, the support plate comprising an upper hinge locating seat portion positioned adjacent the upper aperture and recessed from the reclined front panel by a first predetermined distance, and a lower hinge locating seat portion positioned adjacent the lower aperture and recessed from the inclined front panel by a second predetermined distance; and, a pivoting member having pivotally connected first and second end portions which pivot about the first vertical axis, the first end portion being mounted to the door and the second end portion being mounted with the reclined front panel via the support plate, the second end portion comprising upper and lower horizontally extending arms that pass through the upper and lower apertures in the reclined front panel, the upper and lower horizontally extending arms being attached to the support plate respectively at the recessed upper and lower hinge locating seat portions, and the upper and lower arms having respective predetermined lengths between the first vertical axis and the respective recessed upper and lower hinge locating seat portions chosen relative to the first and second predetermined distances so as to vertically locate the first vertical axis.

14. The clothes dryer of claim 13 wherein the support plate comprises upper and lower recessed wall portions that respectively include the upper and lower hinge locating seat portions.

15. The clothes dryer of claim 14 wherein the upper and lower recessed wall portions respectively abut the upper and lower horizontally extending arms and the assembly further comprising mounting screws that pass through the upper and lower horizontally extending arms and through the upper and lower recessed wall portions at the recessed upper and lower hinge locating seat portions to mount the second end portion of the pivoting member to the support plate of the hinge assembly.

16. The clothes dryer of claim 15 wherein the upper and lower recessed wall portions respectively slope over the upper and lower apertures at a second predetermined angle whereby the screws are inserted into the upper and lower arms through the upper and lower apertures.

17. The clothes dryer of claim 16 wherein the second predetermined angle is 60 degrees.

18. The clothes dryer of claim 13 wherein the first predetermined angle is in the range of 1 to 3 degrees.

19. The clothes dryer of claim 13 wherein the first predetermined angle is 1.38 degrees.

20. The clothes dryer of claim 13 wherein the reclined front panel comprises a main portion and a recessed skirt portion that the surrounds the access opening and is recessed from the main portion, and the spaced apart upper and lower apertures are located in the skirt portion adjacent the one side portion of the access opening.

* * * * *